US008403408B2

(12) United States Patent
Hosler

(10) Patent No.: US 8,403,408 B2
(45) Date of Patent: Mar. 26, 2013

(54) PERSONAL SUPPORT DEVICE

(76) Inventor: Eric Hosler, Tacoma, WA (US)

( * ) Notice: Subject to any disclaimer, the term of this patent is extended or adjusted under 35 U.S.C. 154(b) by 197 days.

(21) Appl. No.: 13/029,996

(22) Filed: Feb. 17, 2011

(65) Prior Publication Data

US 2011/0198897 A1 Aug. 18, 2011

Related U.S. Application Data

(60) Provisional application No. 61/305,889, filed on Feb. 18, 2010.

(51) Int. Cl.
*A47C 9/00* (2006.01)
*A47C 9/10* (2006.01)
*A47C 1/00* (2006.01)

(52) U.S. Cl. ..... 297/4

(58) Field of Classification Search ..... 297/4
See application file for complete search history.

(56) References Cited

U.S. PATENT DOCUMENTS 406,328 A * 7/1889 Yagn ..... 297/4 X
671,638 A * 4/1901 Slagle ..... 297/4
690,122 A * 12/1901 Slagle ..... 297/4 X
2,099,345 A * 11/1937 Olszanowski ..... 297/4
3,467,033 A * 9/1969 Remer et al. ..... 108/150
4,085,686 A * 4/1978 Turner et al. ..... 108/25
4,183,579 A * 1/1980 Gonzalez y. Rojas ... 297/195.11
4,433,870 A * 2/1984 Bairen et al. ..... 297/4 X
4,641,882 A * 2/1987 Young ..... 297/4 X
4,676,547 A * 6/1987 Spillman ..... 297/4
4,930,839 A * 6/1990 Saito et al. ..... 297/4 X
5,178,595 A * 1/1993 MacGregor ..... 482/75
5,230,700 A * 7/1993 Humbert et al. ..... 602/23
5,411,313 A * 5/1995 Counihan et al. ..... 297/118
5,495,867 A 3/1996 Block
5,673,966 A * 10/1997 Morton, Jr. ..... 297/4
5,720,522 A * 2/1998 Habeck ..... 297/337
5,927,797 A * 7/1999 Ferguson ..... 297/4
5,954,248 A * 9/1999 Jasper ..... 297/4 X
6,033,016 A * 3/2000 Haywood ..... 297/195.11
6,062,638 A 5/2000 Ferguson
6,192,908 B1 2/2001 Smith
6,893,097 B1 * 5/2005 Ebensperger et al. ..... 297/4 X
6,959,716 B1 * 11/2005 Schrader ..... 135/66
6,997,511 B2 * 2/2006 Marchand et al. ..... 297/314
7,293,827 B2 * 11/2007 Schrader ..... 297/195.11
7,396,083 B2 * 7/2008 Kasner ..... 297/4 X
7,594,696 B2 * 9/2009 Girard ..... 297/195.11
7,726,729 B2 * 6/2010 Groll ..... 297/4
7,980,625 B2 * 7/2011 Worthington ..... 297/4
2005/0242630 A1 11/2005 Miller
2009/0235966 A1 9/2009 Birnbaum
2009/0250088 A1 10/2009 Gibbons et al.
2009/0266392 A1 10/2009 Campbell et al.

* cited by examiner

*Primary Examiner* — Rodney B White
(74) *Attorney, Agent, or Firm* — Kelly & Kelley, LLP

(57) ABSTRACT

A personal support device includes a single elongated non-linear shaft having a support attached to a top end thereof and a tip attached to a bottom end thereof. The shaft is arced or includes a bend that defines upper and lower portions of the shaft which are angularly offset from one another. The support is configured to be at least partially disposed below the pelvis and extend between the legs of the individual supported by the device, with the shaft extending to a support surface either in front of or behind the individual.

23 Claims, 7 Drawing Sheets

PERSONAL SUPPORT DEVICE

BACKGROUND OF THE INVENTION

The present invention generally relates to devices and apparatuses for supporting an individual. More particularly, the present invention resides in a portable monopod support and stabilizing device for standing individuals.

There are many occupations and instances where individuals must stand erect for prolonged periods of time. Musicians, for example, be they singers, conductors or instrumentalists, must sometimes stand for very long periods, hours even, during some performances. Sales and checkout clerks at department stores, grocery stores and the like must also stand erect for many hours at a time during their shift. There are many other occupations and activities which require an individual to stand in a relatively confined area or even in the same location for many minutes or hours. There are other instances which are not occupation related which also require standing for long periods of time. For instance, homemakers or individuals standing in line, such as at an amusement park or waiting for tickets.

Fatigue, discomfort, pain and even injury can result from standing erect for prolonged periods of time. People have even been known to faint, including choir members, during very long performances. Also, proper posture can be extremely important to performing music at one's best. Of course, the fatigue, discomfort and pain associated with standing erect for prolonged periods of time hinders such posture. Furthermore, many individuals with injuries, arthritis or other conditions simply cannot stand erect for prolonged periods.

Of course, chairs, stools, benches and the like are well known for enabling one to sit and relieve the fatigue, pain and discomfort to the back, legs, knees, feet, etc., at least temporarily. However, in many of the situations in which an individual must stand erect for prolonged periods of time, such chairs, stools, benches, etc. simply are not practical. For example, a choir standing on stadium-style bleachers does not have sufficient room for chairs, stools or the like. Moreover, such chairs, stools and the like cannot be used while the individual is standing and performing.

Accordingly, there is a continuing need for an apparatus which is portable and small and can support and stabilize an individual who must stand erect for prolonged periods of time. The present invention fulfills these needs and provides other related advantages.

SUMMARY OF THE INVENTION

The present invention resides in a device which is portable and small and can support and stabilize an individual who must stand erect for prolonged periods of time. The support device is configured as a monopod in order to facilitate its use in areas lacking space, as well as to make the device easy to transport and store. Moreover, the device of the present invention is configured so as to support an individual while he or she is standing erect, and not in a seated position, which is desirable in many circumstances.

Generally, the device comprises a single elongated shaft having a support attached to a top end thereof and a tip attached to the bottom end thereof for engaging a support surface. The support is configured to be at least partially disposed below a pelvis and extend between the legs of the human supported by the device. When in use, the device is either placed in front of or behind the user such that the shaft extends either in front of or behind the individual supported by the device with the support disposed below the pelvis and between the legs of the individual.

A single elongated non-linear shaft extends between the support and the tip. In one embodiment, the shaft is generally curved along a length thereof. In another embodiment, the shaft includes a bend formed therein. The bend of the shaft defines an upper portion of the shaft and an adjacent lower portion of the shaft angularly offset from one another. Typically, the shaft includes a bend therein adjacent to the bottom end of the shaft so as to define the upper and lower portions of the shaft, the upper portion of the shaft being of greater length than the lower portion of the shaft.

In a particularly preferred embodiment, the shaft is selectively adjustable in length. The shaft may comprise a pull slidably received within a tube. A locking mechanism is used to lock the length of the shaft. Such a locking mechanism may comprise a series of generally aligned apertures formed in the tube, and a pin associated with the pull and biased so as to extend through an aligned aperture of the tube to lock the tube and pull with respect to one another.

Preferably, the tip is configured to grippingly engage the support surface, such as a floor or ground surface. As such, the tip may comprise an elastomeric material. Typically the bottom surface of the tip has a larger diameter than the shaft. The tip may include channels formed on the bottom surface thereof, or a plurality of projections extending therefrom for grippingly engaging the surface.

In one embodiment, a projection extends generally transverse to the shaft intermediate the ends thereof. The projection is configured to facilitate transport or storage of the device.

Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENTS

Figure 1:
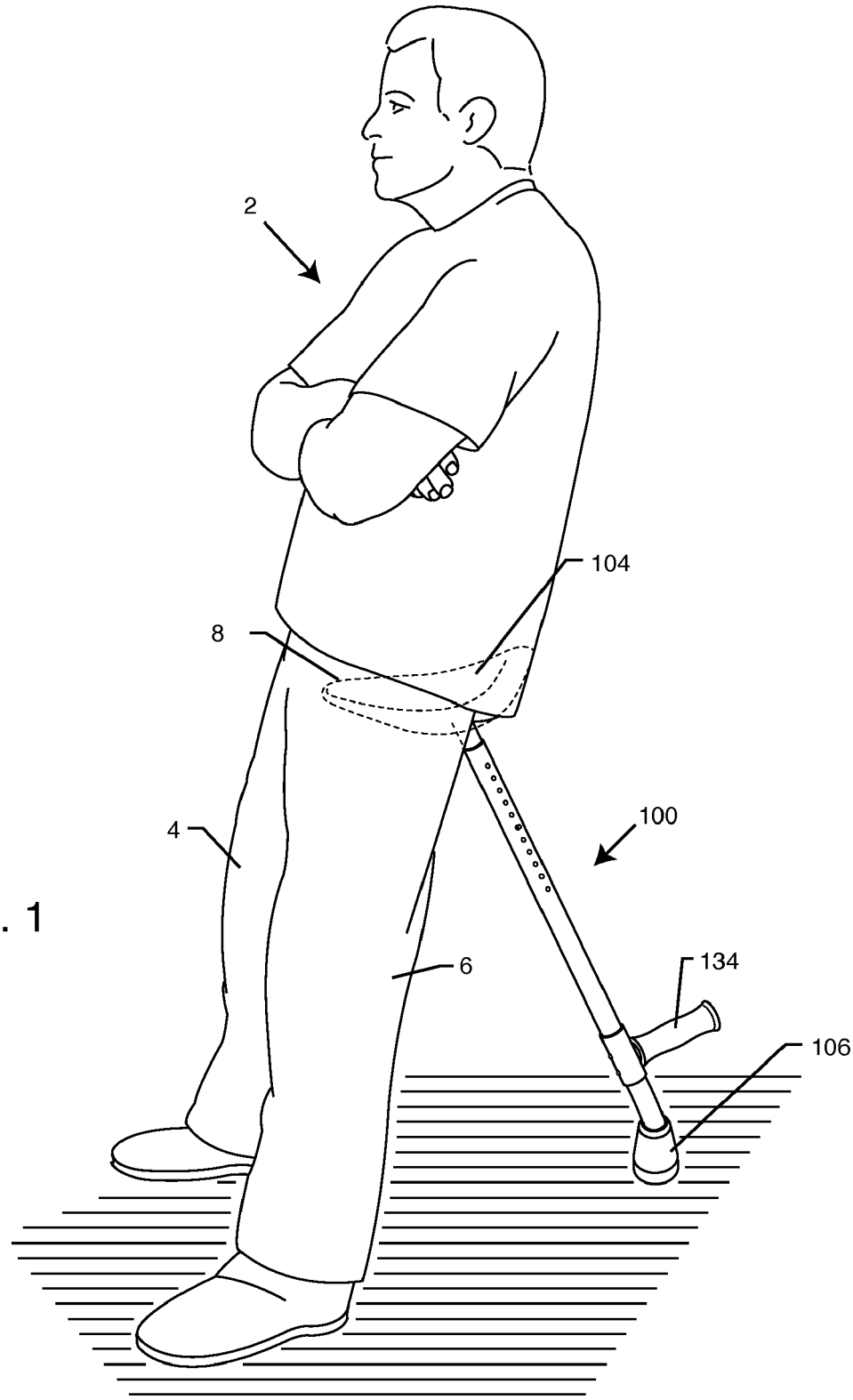
FIG. 1 is a diagrammatic view of a human being supported and stabilized in a standing erect position by the support device of the present invention.

As shown in the accompanying drawings, for purposes of illustration, the present invention resides in a portable support device 100 for supporting and stabilizing standing humans. With reference now to FIG. 1, a device 100 embodying the present invention is illustrated in use supporting an individual 2 while that individual is standing substantially erect. As will be more fully described herein, the support device 100 is in the form of a monopod and enables the user thereof to be at least partially supported and stabilized while standing substantially erect on the user's two feet. As a partial support for the standing individual, the individual is stabilized by the device 100 such that the individual is free to use both hands and arms as needed. In essence, the device 100 of the present invention serves as a third leg to create a functioning tri-pod in combination with the individual's own two legs 4 and 6.

Figure 2:
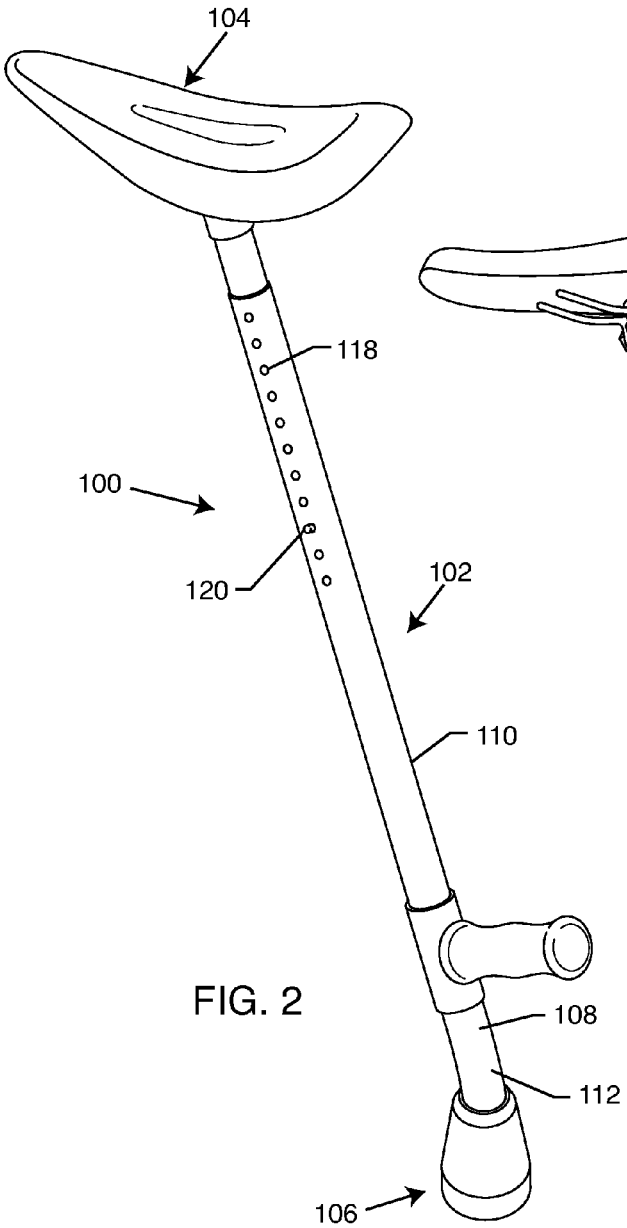
FIG. 2 is a side and top perspective view of the support device embodying the present invention.
Figure 3:
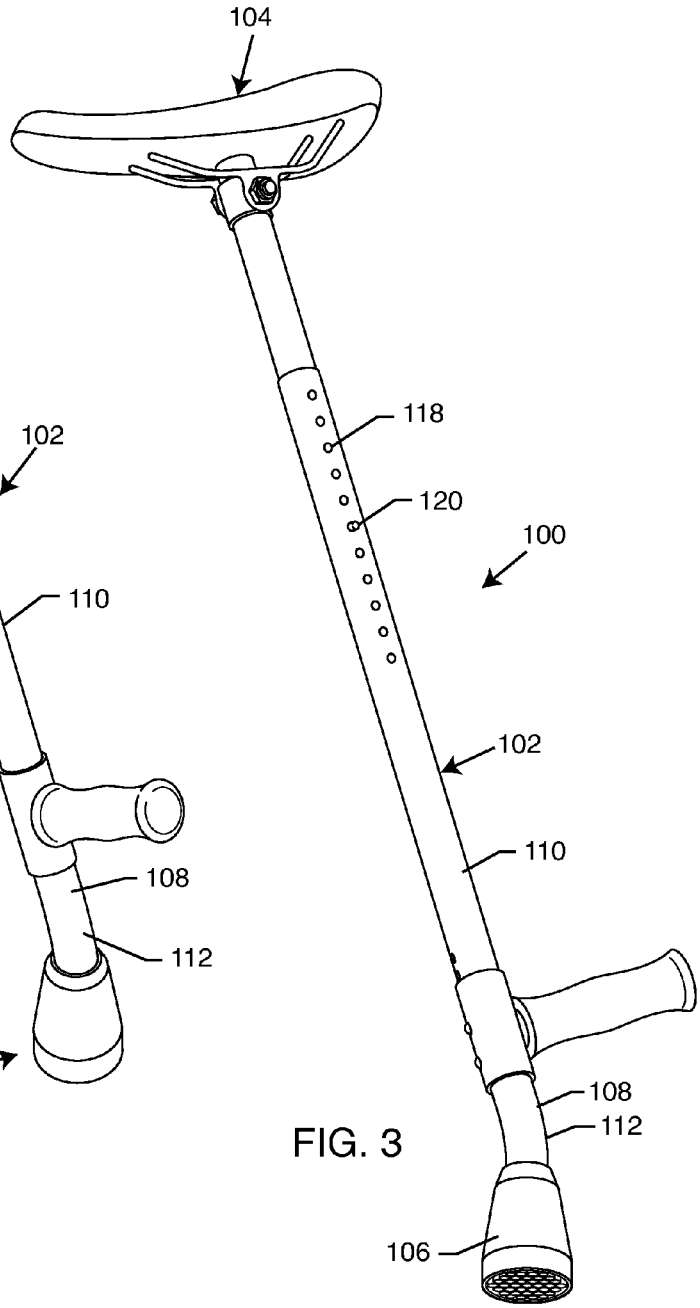
FIG. 3 is a bottom and side perspective view of the device of FIG. 1.

With reference now to FIGS. 2 and 3, the support device 100 is generally comprised of an elongated shaft 102 having a support 104 attached to an upper end thereof and a tip 106 attached to a lower end thereof.

The shaft 102 is comprised of a substantially strong and durable material so as to support at least a portion of a human's weight. In one embodiment, the shaft 102 includes a bend 108 so as to define an upper shaft portion 110 and a lower shaft portion 112 angularly offset from one another. In a particularly preferred embodiment, the bend 108 is formed in the shaft 102 near the lower end thereof such that the upper shaft 110 is of a much greater length than the lower shaft portion 112. In fact, it is preferred that the lower shaft portion 112 be of a length of only inches, whereas the upper portion of the shaft 110 is at least a foot or two in length so as to accommodate an average sized adult human. The angular offset between the upper and lower portions of the shaft 110 and 112 enable the device 100 to support and stabilize the individual 2 on various support surfaces to a much greater extent than if the shaft portions 110 and 112 were not angularly offset from one another, and the bend 108 not present in the shaft 102.

Figure 4:
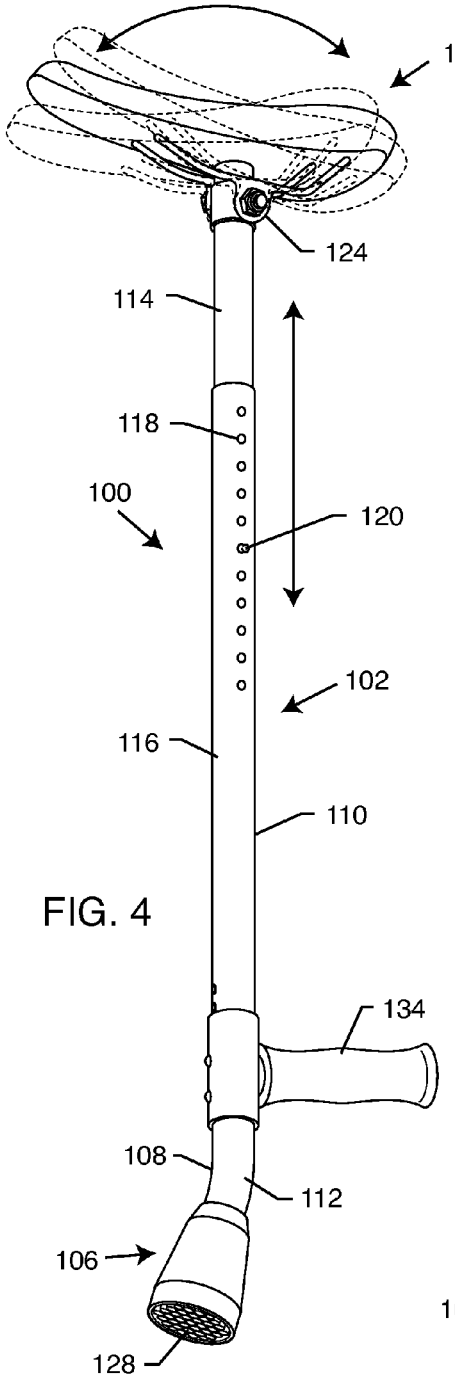
FIG. 4 is a side elevational view, illustrating a pivoting support and adjustable shaft of the device, in accordance with the present invention.

With reference to FIGS. 2-5, in a particularly preferred embodiment, the shaft 102 is selectively adjustable in length. In the illustrated embodiment, a pole 114 is slidably insertable into a hollow tube 116 and extended therefrom and inserted therein in order to adjust the overall length of the shaft 102, as illustrated in FIG. 4.

A locking mechanism is used to selectively lock the length of the shaft 102. This allows the device 100 to be adjusted in length to accommodate users of different height. In the embodiment illustrated in FIGS. 2-5, the tube 116 has a plurality of aligned apertures 118 formed therein. The pole 114 has a pin 120 which is biased outwardly, such as by using a spring or other resilient member as is known in the art, such that the pin or button 120 extends through an aligned aperture 118, so as to lock the pole 114 with respect to the tube 116 and affix the length of the shaft 102. The button or pin 120 can be depressed inwardly and the pole 114 moved inward or outward the tube 116 so as to adjust the overall length of the shaft 102 until it is again locked into place in one of the apertures 118 of the tube 116. The vertical directional arrow in FIG. 4 illustrates the adjustable nature of the shaft 102. It will be appreciated that although the pin 120 and series of apertures 118 locking mechanism has been illustrated, other locking mechanisms, such as a clamp or the like, could be used instead. In addition to accommodating users of different height, the telescopic nature of the shaft 102 enables the device 10 to be moved into a relatively small and compact length for easy transportation and storage of the device 100.

Figure 6:
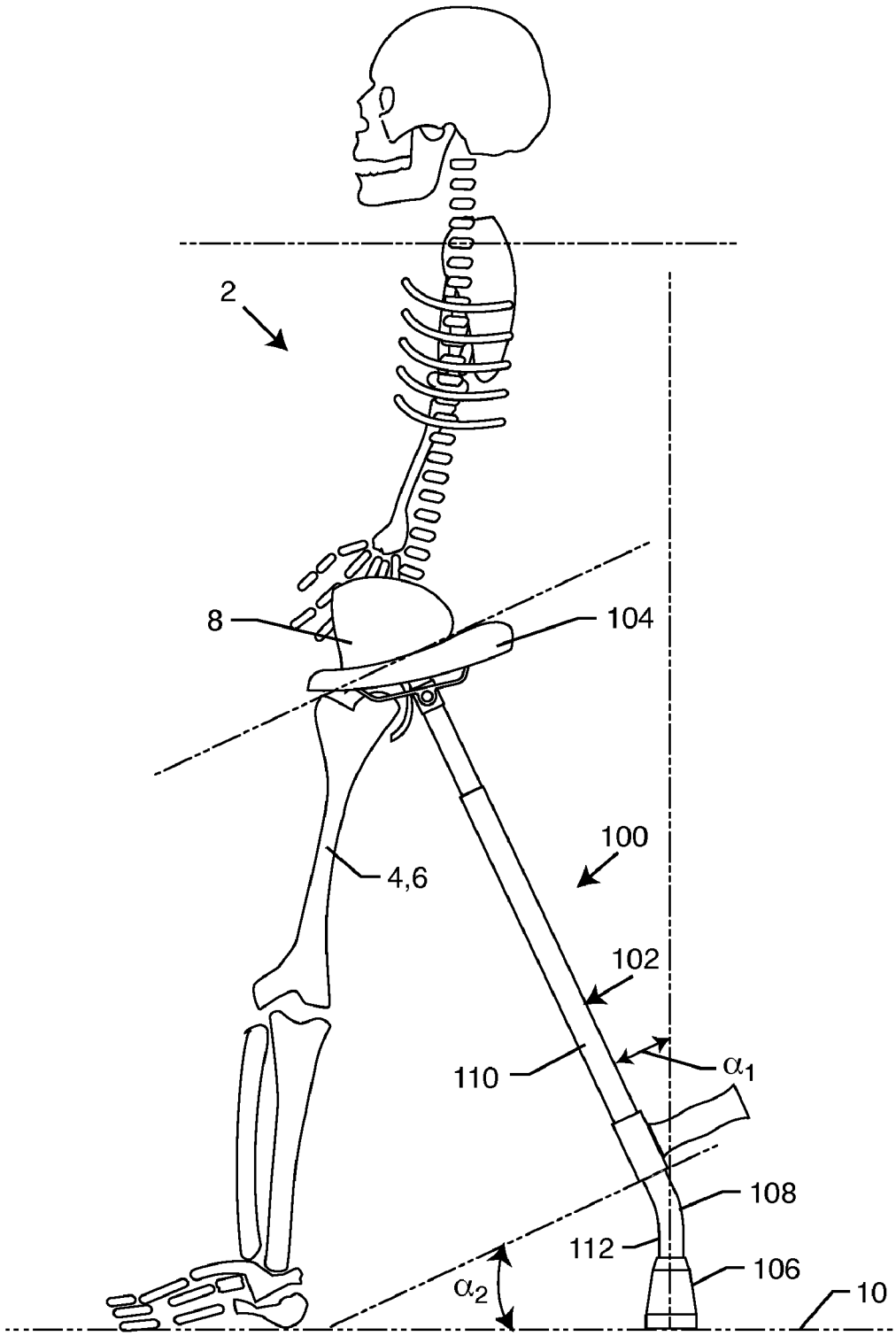
FIG. 6 is a diagrammatic view illustrating the device of the present invention in use and extending behind a user thereof.
Figure 7:
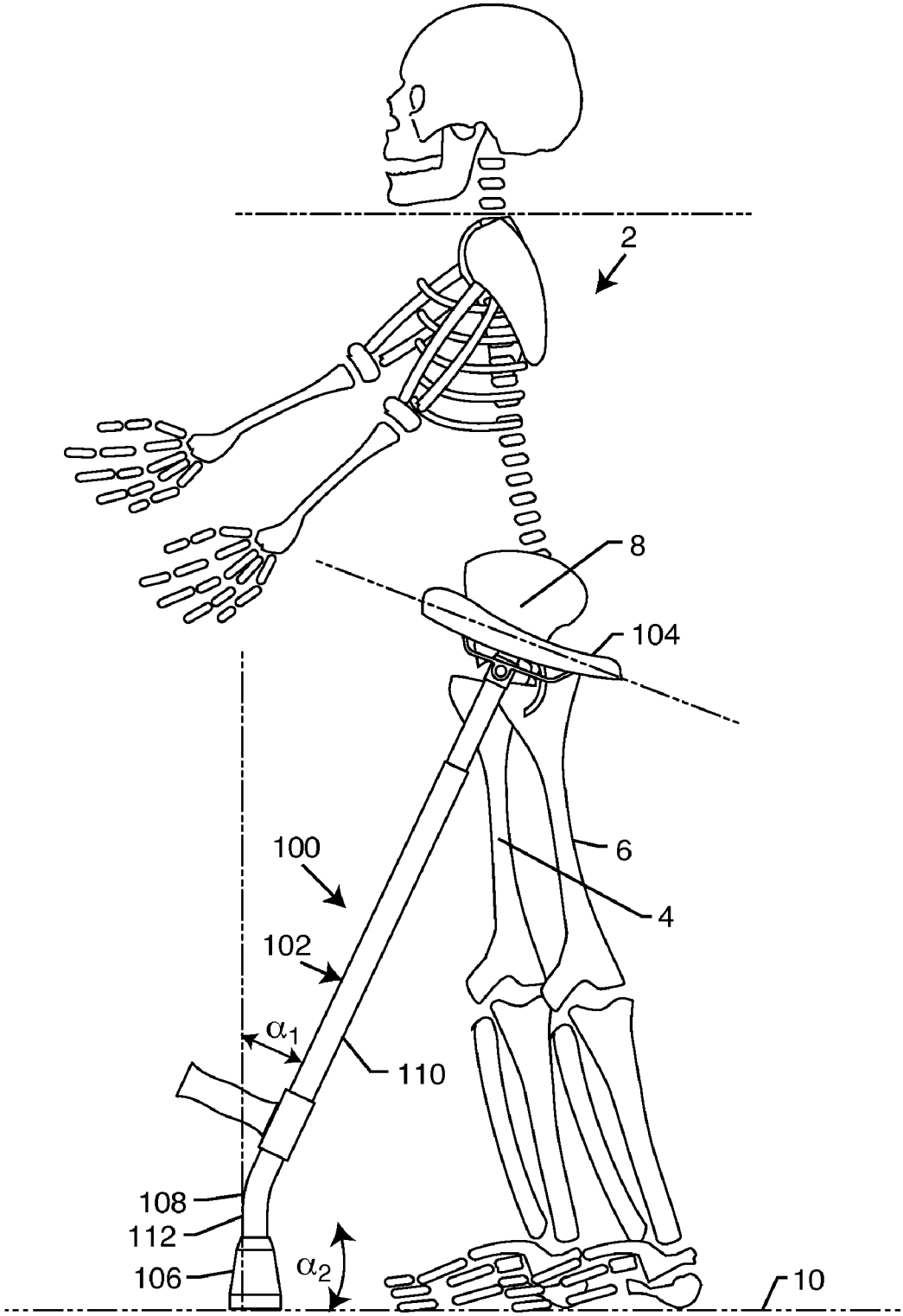
FIG. 7 is a diagrammatic view similar to FIG. 6, but illustrating the device of the present invention positioned in front of the user.

With continuing reference to FIGS. 2-5, an exemplary support 104 is shown. The support 104 is not to be sat on in the traditional sense, in that the individual does not place his or her buttocks on the support 104 and sit thereon. Instead, as shown in FIGS. 1,6 and 7, the support 104 is configured to be placed in the individual's crotch, so as to be disposed and extend between the user's legs 4 and 6 with the user's pelvis 8 resting thereon. The user 2 straddles the support 104 between his or her legs 4 and 6, wherein the user's pelvis 8 rests on the support 104 so as to support the upper body of the user 2, as illustrated in FIGS. 6 and 7. Thus, the support 104 must be of a sufficiently narrow width so as to comfortably fit between the user's legs 4 and 6, while still providing a sufficient area so as to support the user's pelvic region 8 thereon. By way of example, a typical support 104 would be at least two inches in width but less than eight inches. The length of the support 104 must be sufficient so as to extend between the user's legs 4 and 6 while enabling the user to slightly lean backwards, as illustrated in FIG. 6, or forward, as illustrated in FIG. 7, onto the support 104. Preferably, the support 104 is cushioned to provide comfort to the user.

Figure 5:
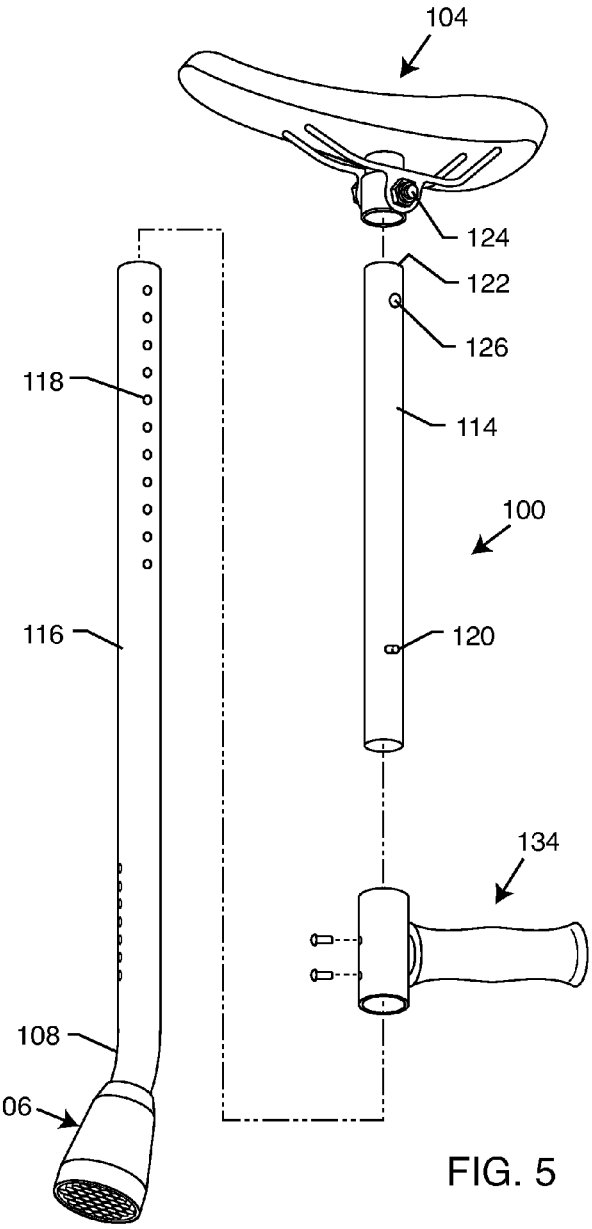
FIG. 5 is an exploded perspective view of the device of the present invention.

With particular reference now to FIGS. 4 and 5, the support 104 is attached to the upper end 122 of the shaft 102 such as by insertion of a bolt 124 through an aperture 126 so as to secure the support 104 onto the shaft 102. Other attachment means are contemplated by the present invention, such as clamps or the like. As illustrated in FIG. 4, the support 104 may be positioned pivotally and rotated to suit the comfort and needs of the user.

With reference now to FIGS. 6 and 7, diagrammatic views for purposes of illustration are shown with the user 2 at least partially supported and stabilized by the device 100. FIG. 6 illustrates the device 100 with the shaft extending behind the user 2, and the user 2 slightly leaning backwards onto the support 104, whereas FIG. 7 illustrates the device 100 positioned in front of the user with the shaft extending downwardly from the user to the support surface 10 with the user leaning slightly forward. The same device 100 can be used in either direction, with the positioning of the device 100 being either a preference of the user 2 or a preferred position depending upon the activity in which the user 2 is engaged.

It will be appreciated that the device 100, in order to be used properly, will not be perfectly vertical with respect to the ground surface 10. Instead, typically the lower portion 112 of the shaft 102 is substantially vertical with respect to the support surface 10, while the upper portion 110 of the shaft 102 is angled towards the user. As shown in FIGS. 6 and 7 by the dashed vertical line, there is an angle $\alpha$, which the upper portion of the shaft 110 extends away from vertical. This is typically between five degrees and forty degrees from vertical. A more typical range is between fifteen degrees and thirty-five degrees from vertical. It will also be seen that there is an angle between the supporting surface 10 and the upper portion 110 of the shaft 102 which forms an angle $\alpha_2$. This angle $\alpha_2$ forms an imaginary plane at approximately the bend 108 which may be substantially parallel to the support 104, as illustrated by the dashed lines. Notwithstanding this, the upper body of the user 2 is typically in more of an upright position. The support 104 can be pivoted to a position where it is substantially parallel with the floor or other support surface 10 which further enables the individual's upper body to be more in an upright position. Although, the upper body of the user 2 may be slightly angled backwards when positioned according to FIG. 6, or leaning slightly forward when positioned according to FIG. 7. The angular offset between the upper and lower portions 110 and 112 of the shaft 102 facilitates the user 2 being positioned substantially erect standing on his or her legs 4 and 6 while being at least partially supported by the device 100. In conjunction with the user's legs 4 and 6, the monopod device 100 essentially cooperatively forms a tripod arrangement and stable base with the user's legs 4 and 6. The gripping action between the tip 106 and the supporting surface 10 is significantly enhanced by the curve or angle providing contact of the tip nearer to the user than the projected end of the line of force along which the user's body weight is transferred to the supporting surface 10. The resulting torque forces the tip 106 into maximum contact; the resulting friction causing the gripping of the device to the supporting surface.

It will be appreciated that other configurations of the shaft are possible and yet achieve the objectives of the present invention. More particularly, the shaft of the device of the present invention is non-linear such that the configuration of the shaft and the force applied thereto enhances the gripping engagement of the tip 106 with the floor or support surface 10. It has been found that having a non-linear shaft provides benefits which exceed that of a straight or linear shaft or pole. As such, the shaft could include more than one bend therein, for example to create a recurved or "S-shaped" shaft.

Figure 8:
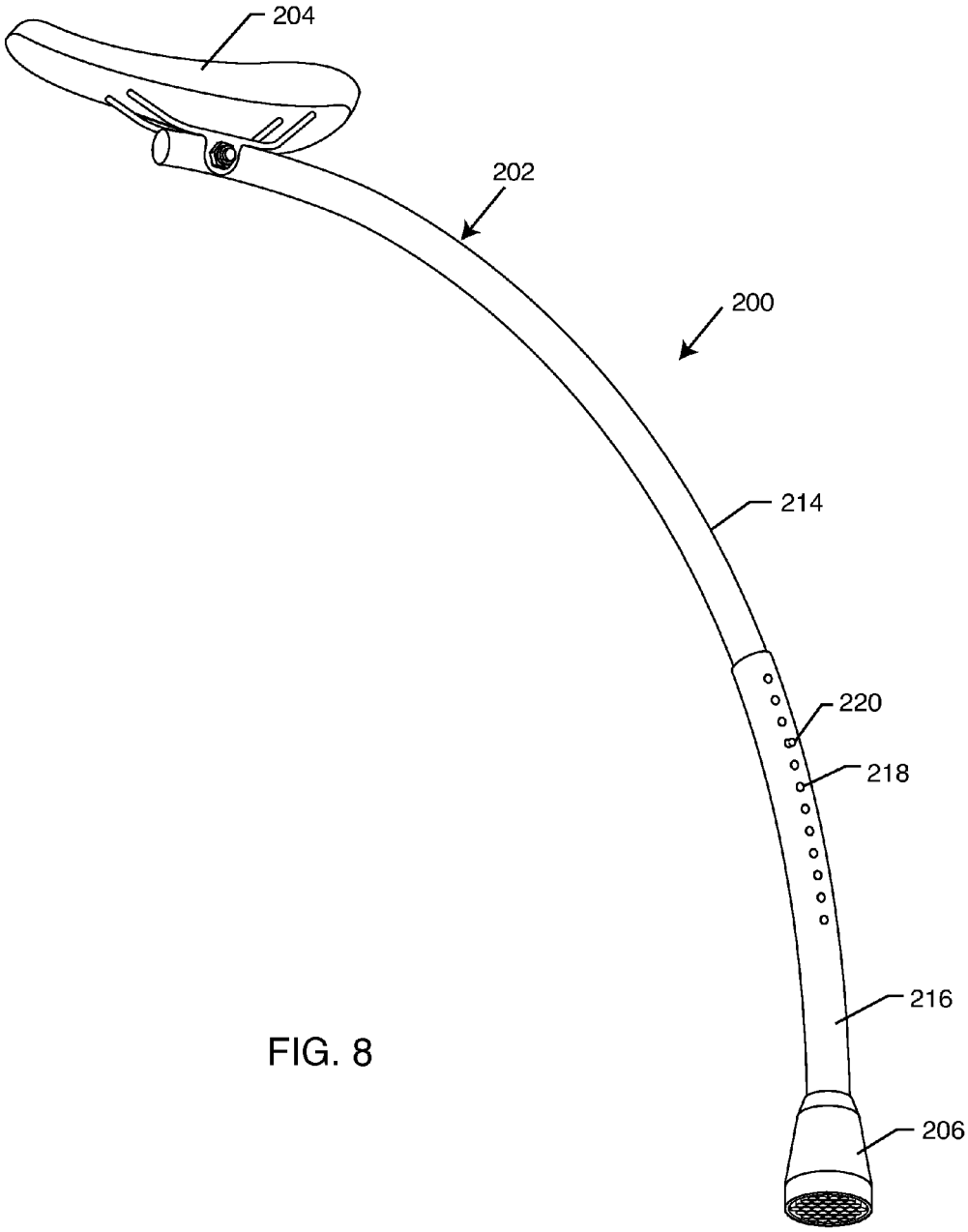
FIG. 8 is a side perspective view of another device embodying the present invention.

With reference now to FIG. 8, another embodiment of the device 200 is shown with a non-linear shaft 202. The shaft 202 is curved along a length thereof so as to form a single curved shaft 202. A support 204, similar to that described above, is attached to an upper end of the shaft 202 and a tip 206 is attached to a bottom end thereof.

In a particularly preferred embodiment, as described above, the shaft 202 is comprised of a pole 214 slidably received within a tube 216 such that the overall length of the shaft 202 is adjustable. Once again, a locking mechanism is provided for locking the length of the shaft, such as the illustrated series of apertures 218 having a pin or button 220 extendable therethrough so as to selectively lock the pole 214 and tube 216 relative to one another.

The shaft 202 is of such a curvature such that an individual straddling the support 204 and supported by the device 200 exerts a downward force through the shaft 202 and to the tip 206 in such a manner that the tip 206 is firmly gripped and engaged with the underlying support surface 10. Moreover, similar to the angular embodiment illustrated above, the tip 206 and lower portion of the shaft 202 are generally vertical with respect to the horizontal support surface 10 when in use, whereas the upper portion of the shaft 202 extends towards the user and support 204 at a non-vertical angle. In essence, the obtuse angle of the embodiment illustrated in FIGS. 1-7 is replaced with an arcing shaft so that the same angle is accomplished gradually over the entire length of the shaft 202. The arcing shaft 202 may also include an increased, but still slight angle, near the tip 206, as deemed necessary to maximize torque and engagement with the supporting surface 10.

It has been found that the non-linear configuration of the shaft 102 or 202 enhances the gripping of the tip 106 or 206. The tip 106 or 206 is typically of a larger diameter at the base 128 thereof than the diameter of the shaft 102 or 202. The stability of the tip 106 or 206 is an important feature of the invention as a considerable amount of weight and force will be applied thereto. For indoor settings, the tip 106 or 206 is typically comprised of an elastomeric material, such as polyurethane having a desirable Shore value so as to grip the surface, which may comprise a tiled, wood, or similar slick surface.

Figure 9:
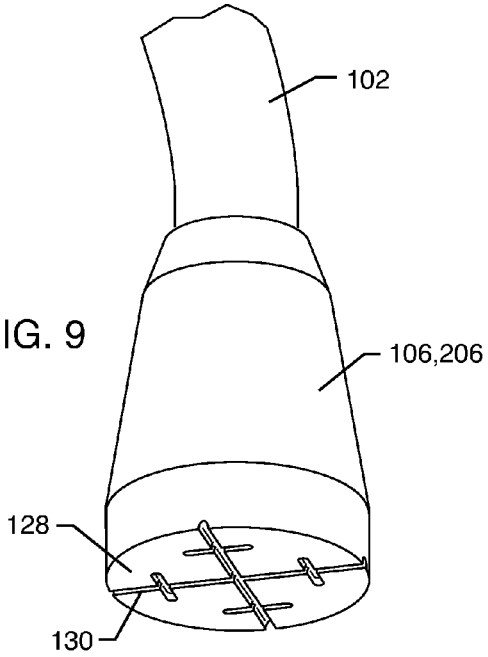
FIG. 9 is an enlarged perspective view of a tip of the device of the present invention.
Figure 10:
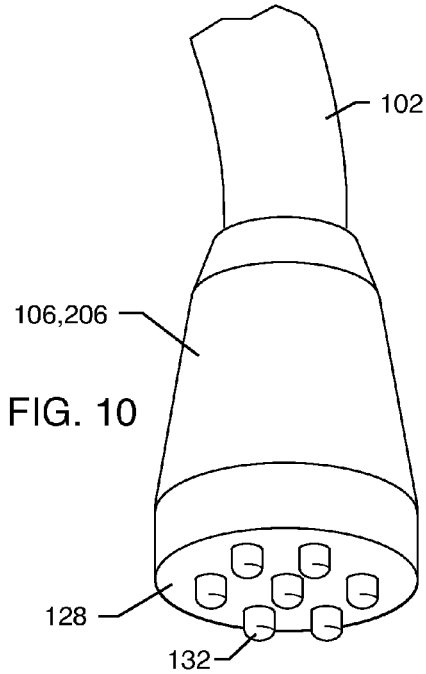
FIG. 10 is an enlarged and perspective view of another tip used in accordance with the present invention.

With reference now to FIG. 9, a tip 106 or 206 is illustrated having channels 130 formed in the bottom surface 128 thereof. Such channels 130 have been found to facilitate the gripping of the tip 106 or 206 on otherwise slippery surfaces, such as tile, polished wood, and the like. Air is able to escape from the channels 130 as the elastomeric tip 106 or 206 is compressed onto the support surface. FIG. 10, on the other hand, illustrates a tip 106 or 206 having a plurality of protrusions 132 extending therefrom which serve to dig into and grip other supporting surfaces, such as grass, dirt, carpet or the like. Thus, it will be appreciated that the tip 106 or 206 can be comprised of various materials and have various configurations so as to securely grip and provide a supported base for the device 100 or 200 when in use.

Although in the preferred embodiment the tip has a generally flat bottom surface 128, it will be appreciated that the tip can also be beveled. This can also be used to create the desired angle between the ground surface 10 and the shaft. In any event, the user's body weight travels along the line of the shaft to the support surface 10 and acts as a clamping force that also torques the shaft forcing the tip to fully engage the supporting surface.

Figure 11:
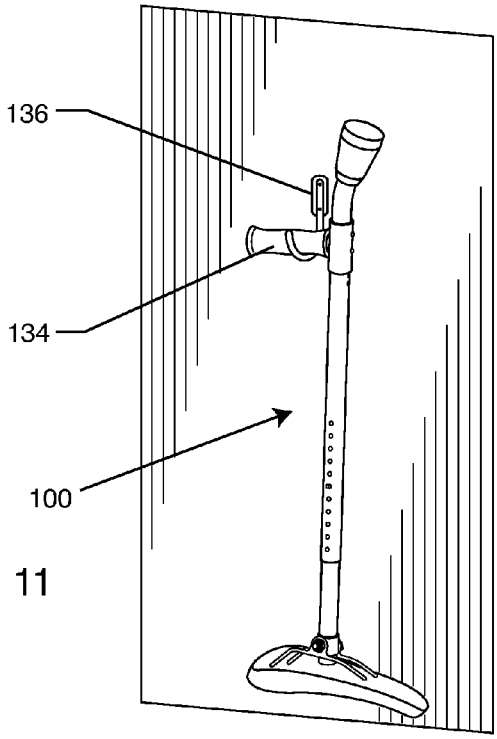
FIG. 11 is a diagrammatic perspective view illustrating the device having a projection thereof placed on a hook for storage purposes.

With reference now to FIGS. 4, 5 and 11, the device 100 may include a projection 134 which is configured to facilitate transport or storage of the device 100 or 200. Such a projection 134 can comprise a handle grip, as illustrated. The handle grip projection 134 is attached to the shaft 102 so as to extend generally transverse thereto. The projection 134 can be used to hold and carry the device 100 or for hanging, such as on a hook 136 of a door, wall, or other surface for storage purposes. Of course, it will be appreciated that the projection handle 134 is for sake of convenience in carrying and storing the device 100. The projection 134 can have different configurations than that illustrated, so as to hang on a belt loop or pants pocket, sling or the like so as to allow the user to transport the device 100 without having to hold it in his or her hands.

It will be appreciated that the device of the present invention provides many advantages which are simply not currently available in other devices to individuals who must stand erect for prolonged periods of time. The device of the present invention is very small and portable. Moreover, the device of the present invention needs very little room to be used, enabling it to be used by individuals where a stool or chair simply would not be accommodated. Furthermore, the configuration and design of the present invention is particularly suitable for musicians, singers and the like who must be in an essentially erect and standing position for posture and appearance purposes, which could not be provided by sitting on a stool, chair or the like. The device of the present invention will significantly reduce the fatigue, discomfort, pain and injury associated with standing for long periods, while still allowing the individual to perform the necessary tasks, many of which require both user's hands and arms.

Although several embodiments have been described in detail for purposes of illustration, various modifications may be made without departing from the scope and spirit of the invention. Accordingly, the invention is not to be limited, except as by the appended claims.

What is claimed is:

1. A personal support device for a non-mobile, standing individual, comprising:

a single elongated non-linear shaft comprising a pole slidably received within a tube so as to be selectively adjustable in length;

a locking mechanism for locking the length of the shaft;

a support attached to a top end of the shaft; and a tip attached to a generally opposite bottom end of the shaft which engages a support surface;

wherein the shaft extends either in front of or behind the individual supported by the device; and wherein the support is configured to be at least partially disposed below a pelvis and extend between the legs of the individual supported by the device.

2. The support device of claim 1, wherein the shaft includes a bend formed therein.

3. The support device of claim 2, wherein the bend of the shaft defines an upper portion of the shaft and an adjacent lower portion of the shaft angularly offset from one another.

4. The support device of claim 3, wherein the upper portion of the shaft is of a greater length than the lower portion of the shaft.

5. The support device of claim 1, including a series of generally aligned apertures formed in the tube, and a pin associated with the pole and biased so as to extend through an aligned aperture of the tube to lock the tube and pole with respect to one another.

6. The support device of claim 1, wherein the tip comprises an elastomeric material.

7. The support device of claim 1, wherein a bottom surface of the tip has a larger diameter than the shaft.

8. The support device of claim 1, wherein the tip includes a plurality of projections extending therefrom for grippingly engaging a surface.

9. The support device of claim 1, wherein the tip includes channels formed on a bottom surface thereof.

10. The support device of claim 1, wherein the shaft is generally curved substantially along a length thereof so as to be generally arcuate in configuration.

11. A personal support device, comprising:

a single elongated shaft of adjustable length having a bend adjacent to a bottom end thereof so as to define an upper shaft portion and a lower shaft portion angularly offset from one another, the upper shaft portion having a greater length than the lower shaft portion;

a locking mechanism for selectively locking the length of the shaft;

a support attached to a top end of the shaft; and a tip attached to the bottom end of the shaft which engages a support surface;

wherein the shaft extends either in front of or behind an individual supported by the device; and wherein the support is configured to be at least partially disposed below a pelvis and extend between the legs of the individual supported by the device.

12. The support device of claim 11, wherein the shaft comprises a pole slidably received within a tube.

13. The support device of claim 12, wherein the locking mechanism comprises a series of generally aligned apertures formed in the tube, and a pin associated with the pole and biased so as to extend through an aligned aperture of the tube to lock the tube and pole with respect to one another.

14. The support device of claim 11, wherein a bottom surface of the tip has a larger diameter than the shaft.

15. The support device of claim 11, wherein the tip includes a plurality of projections extending therefrom for grippingly engaging a surface.

16. The support device of claim 11, wherein the tip includes channels formed on a bottom surface thereof.

17. A personal support device for a non-mobile, standing individual, comprising:

a single elongated shaft curved generally along the length thereof so as to be generally arcuate in configuration;

a locking mechanism for selectively locking the length of the shaft;

a support attached to a top end of the shaft; and a tip attached to a bottom end of the shaft which engages a support surface;

wherein the shaft extends either in front of or behind the individual supported by the device; and wherein the support is configured to be at least partially disposed below a pelvis and extend between the legs of the individual supported by the device.

18. The support device of claim 17, wherein the shaft is adjustable in length and comprises a pole slidably received within a tube.

19. The support device of claim 18, including a series of generally aligned apertures formed in the tube, and a pin associated with the pole and biased so as to extend through an aligned aperture of the tube to lock the tube and pole with respect to one another.

20. The support device of claim 17, wherein the tip comprises an elastomeric material.

21. The support device of claim 17, wherein a bottom surface of the tip has a larger diameter than the shaft.

22. The support device of claim 17, wherein the tip includes a plurality of projections extending therefrom for grippingly engaging a surface.

23. The support device of claim 17, wherein the tip includes channels formed on a bottom surface thereof.

* * * * *